US008424539B2

(12) United States Patent
Braunshteyn et al.

(10) Patent No.: US 8,424,539 B2
(45) Date of Patent: Apr. 23, 2013

(54) SMOKING ARTICLE WITH SINGLE PIECE RESTRICTOR AND CHAMBER

(75) Inventors: Michael Braunshteyn, Richmond, VA (US); San Li, Midlothian, VA (US); Raquel Olegario, Richmond, VA (US)

(73) Assignee: Philip Morris USA Inc., Richmond, VA (US)

( * ) Notice: Subject to any disclaimer, the term of this patent is extended or adjusted under 35 U.S.C. 154(b) by 973 days.

(21) Appl. No.: 11/890,498

(22) Filed: Aug. 7, 2007

(65) Prior Publication Data

US 2008/0035162 A1 Feb. 14, 2008

Related U.S. Application Data

(60) Provisional application No. 60/836,144, filed on Aug. 8, 2006.

(51) Int. Cl.
*A24D 3/04* (2006.01)

(52) U.S. Cl.
USPC ..... 131/336; 131/339; 131/341

(58) Field of Classification Search ..... 131/339, 131/341, 336
See application file for complete search history.

(56) References Cited

U.S. PATENT DOCUMENTS

| | | | |
|---|---|---|---|
| 2,511,898 | A | 6/1950 | Brothers |
| 2,547,119 | A | 4/1951 | Henderson |
| 2,592,553 | A | 4/1952 | Frankenburg et al. |
| 2,592,554 | A | 4/1952 | Frankenburg |
| 2,598,680 | A | 6/1952 | Frankenburg |
| 2,764,513 | A | 9/1956 | Brothers |
| 2,769,734 | A | 11/1956 | Bandel |
| 2,954,772 | A | 10/1960 | Lebert |
| 2,954,778 | A | 10/1960 | Lebert |
| 2,954,783 | A | 10/1960 | Lebert |
| 2,954,786 | A | 10/1960 | Lebert |
| 3,098,492 | A | 7/1963 | Wurzburg et al. |
| 3,234,949 | A | 2/1966 | White et al. |
| 3,236,244 | A | 2/1966 | Irby, Jr. et al. |
| 3,255,760 | A | 6/1966 | Selke |
| 3,283,762 | A | 11/1966 | Kissel |
| 3,292,635 | A | 12/1966 | Kolodny |
| 3,318,312 | A | 5/1967 | Curtis, Jr. |
| 3,323,525 | A | 6/1967 | Miller |

(Continued)

FOREIGN PATENT DOCUMENTS

| | | | |
|---|---|---|---|
| BE | 679657 | A | 10/1966 |
| BE | 1000454 | A4 | 12/1988 |

(Continued)

OTHER PUBLICATIONS

U.S. Appl. No. 11/727,825, Smoking Article With a Restrictor.

(Continued)

*Primary Examiner* — Richard Crispino
*Assistant Examiner* — Dionne Walls Mayes
(74) *Attorney, Agent, or Firm* — Buchanan Ingersoll & Rooney PC

(57) ABSTRACT

A smoking article having a filter segment that establishes both a desired resistance to draw and a mixing of mainstream smoke with ventilation air. The filter segment includes a fluted portion, a frusto-conical portion and axially extending orifices establishing fluid communication between the frusto-conical portion and voids between one or more walls of the fluted portion.

9 Claims, 3 Drawing Sheets

U.S. PATENT DOCUMENTS 3,356,094 A 12/1967 Ellis et al.
3,389,705 A 6/1968 Levavi
3,395,713 A 8/1968 Ent-Keller
3,441,028 A 4/1969 Wall
3,457,927 A 7/1969 Siragusa
3,496,945 A 2/1970 Tomkin
3,504,677 A 4/1970 Doppelt
3,533,416 A * 10/1970 Berger et al. ..... 131/342
3,581,748 A 6/1971 Cameron
3,599,646 A 8/1971 Berger et al.
3,630,210 A 12/1971 Haslam
3,637,447 A 1/1972 Berger et al.
3,646,941 A 3/1972 Doppelt
3,648,712 A 3/1972 Patterson
3,685,522 A 8/1972 Kleinhans
3,738,375 A 6/1973 Doumas
3,756,249 A 9/1973 Selke et al.
3,759,270 A 9/1973 Wright
3,860,011 A 1/1975 Norman
3,877,470 A 4/1975 Jewett et al.
3,931,824 A 1/1976 Miano et al.
3,968,804 A 7/1976 Kelly et al.
3,986,515 A 10/1976 Egri
4,016,887 A 4/1977 Uroshevich
4,022,222 A 5/1977 Berger
4,038,994 A 8/1977 Aikman
4,091,821 A 5/1978 Scorzo
4,119,105 A 10/1978 Owens, Jr.
4,120,310 A 10/1978 Lee et al.
4,135,523 A 1/1979 Luke et al.
4,158,364 A 6/1979 Ligeti
4,182,349 A 1/1980 Selke
4,186,756 A 2/1980 Takemoto et al.
4,197,863 A 4/1980 Clayton et al.
4,256,122 A 3/1981 Johnson
4,256,126 A 3/1981 Seligman et al.
4,273,141 A 6/1981 Van Tilburg
4,292,983 A 10/1981 Mensik
4,340,072 A 7/1982 Bolt et al.
4,341,228 A 7/1982 Keritsis et al.
4,343,319 A 8/1982 Cantrell
4,357,950 A 11/1982 Berger
4,380,241 A 4/1983 Horsewell
4,386,618 A 6/1983 Cantrell
4,421,126 A 12/1983 Gellatly
4,460,001 A 7/1984 Browne et al.
4,469,112 A 9/1984 Browne et al.
4,506,683 A 3/1985 Cantrell et al.
4,508,525 A 4/1985 Berger
4,515,170 A 5/1985 Cantrell et al.
4,542,755 A 9/1985 Selke et al.
4,559,955 A 12/1985 Brockway et al.
4,564,030 A 1/1986 Jessup et al.
4,574,820 A 3/1986 Pinkerton et al.
4,585,015 A 4/1986 Silberstein
4,617,946 A * 10/1986 Keith ..... 131/336
4,620,553 A 11/1986 Bale et al.
4,622,982 A 11/1986 Gaisch et al.
4,637,409 A 1/1987 Berger
4,646,762 A 3/1987 Riehl et al.
4,649,944 A 3/1987 Houck, Jr. et al.
4,660,579 A 4/1987 Horsewell et al.
4,677,992 A 7/1987 Bliznak
4,687,008 A 8/1987 Houck, Jr. et al.
4,700,726 A 10/1987 Townsend et al.
4,702,263 A 10/1987 Strydom
4,732,168 A 3/1988 Resce et al.
4,754,766 A 7/1988 Luke et al.
4,784,632 A 11/1988 Berger
4,791,943 A * 12/1988 Kupper et al. ..... 131/339
4,793,365 A 12/1988 Sensabaugh et al.
4,867,182 A 9/1989 Roberts et al.
4,896,682 A 1/1990 Liew
4,924,886 A 5/1990 Litzinger
4,942,887 A 7/1990 Abdelgawad et al.
4,949,736 A * 8/1990 Roberts et al. ..... 131/336
4,962,774 A 10/1990 Thomasson et al.
4,972,853 A 11/1990 Brackmann et al.
4,972,854 A 11/1990 Kiernan et al.
4,984,588 A 1/1991 Stewart, Jr.
5,046,514 A 9/1991 Bolt
5,050,621 A 9/1991 Creighton et al.
5,058,608 A 10/1991 Henning et al.
5,060,676 A 10/1991 Hearn et al.
5,074,319 A 12/1991 White et al.
5,099,864 A 3/1992 Young et al.
5,101,839 A 4/1992 Jakob et al.
5,105,836 A 4/1992 Gentry et al.
5,105,838 A 4/1992 White et al.
5,129,408 A 7/1992 Jakob et al.
5,152,304 A 10/1992 Bokelman et al.
5,178,166 A 1/1993 Newsome et al.
5,190,061 A 3/1993 Brackmann et al.
5,203,354 A 4/1993 Hickle
5,360,023 A 11/1994 Blakley et al.
5,392,792 A 2/1995 Banerjee et al.
5,392,793 A 2/1995 Molloy
5,435,326 A 7/1995 Gentry et al.
5,458,107 A 10/1995 Balogh et al.
5,524,647 A 6/1996 Brackmann
5,533,530 A 7/1996 Young et al.
5,568,819 A 10/1996 Gentry et al.
5,584,306 A 12/1996 Beauman et al.
5,598,868 A 2/1997 Jakob et al.
5,666,976 A 9/1997 Adams et al.
5,690,127 A 11/1997 Chapman et al.
5,709,227 A 1/1998 Arzonico et al.
5,715,844 A 2/1998 Young et al.
5,724,998 A 3/1998 Gellatly et al.
5,727,571 A 3/1998 Meiring et al.
5,743,251 A 4/1998 Howell et al.
5,746,230 A 5/1998 Arterbery et al.
5,839,449 A 11/1998 Banerjee et al.
5,954,061 A 9/1999 Cardarelli
5,979,459 A 11/1999 Schneider
6,062,228 A 5/2000 Loercks et al.
6,089,238 A 7/2000 Schneider et al.
6,216,706 B1 4/2001 Kumar et al.
6,257,242 B1 7/2001 Stavridis
6,345,625 B1 2/2002 Chew
6,502,580 B1 1/2003 Luparini
6,718,989 B1 4/2004 Clarke et al.
6,761,174 B2 7/2004 Jupe et al.
6,779,529 B2 8/2004 Figlar et al.
6,814,786 B1 11/2004 Zhuang et al.
6,823,873 B2 11/2004 Nichols et al.
6,883,516 B2 4/2005 Hindle et al.
6,883,523 B2 4/2005 Dante
2002/0166561 A1 11/2002 Sinclair, Jr.
2003/0200973 A1 10/2003 Xue et al.
2003/0200976 A1 10/2003 Yoo
2004/0025890 A1 2/2004 Yen
2004/0159327 A1 8/2004 Dante
2004/0261807 A1* 12/2004 Dube et al. ..... 131/337
2005/0066981 A1 3/2005 Crooks et al.
2006/0201524 A1 9/2006 Zhang et al.
2007/0169785 A1 7/2007 Gedevanishvili et al.
2007/0181140 A1 8/2007 Xue et al.
2007/0186945 A1 8/2007 Olegario et al.
2007/0235050 A1 10/2007 Li et al.
2007/0261706 A1 11/2007 Banerjea et al.
2008/0017204 A1 1/2008 Braunshteyn et al.
2008/0047571 A1 2/2008 Braunshteyn et al.
2008/0163877 A1 7/2008 Zhuang et al.
2008/0216848 A1 9/2008 Li et al.
2008/0216850 A1 9/2008 Li et al.
2008/0216851 A1 9/2008 Olegario et al.
2008/0216853 A1 9/2008 Li et al.
2010/0288293 A1 11/2010 Slasli et al.

FOREIGN PATENT DOCUMENTS

DE 3439861 A1 5/1985
EP 0 054 705 A1 6/1982
EP 0077123 A2 4/1983
EP 0101840 A 3/1984
EP 0212879 4/1987
EP 0 327 655 A1 8/1989

| | | | |
|---|---|---|---|
| EP | 0364256 | A1 | 4/1990 |
| EP | 0471581 | A1 | 2/1992 |
| EP | 0482872 | A1 | 4/1992 |
| EP | 0568107 | A | 11/1993 |
| EP | 0481596 | | 1/1994 |
| FR | 2481581 | | 11/1981 |
| FR | 2873899 | A | 2/2006 |
| GB | 1058342 | A | 2/1967 |
| GB | 1228747 | | 4/1971 |
| GB | 1236344 | A | 6/1971 |
| GB | 1245518 | A | 9/1971 |
| GB | 1256154 | | 12/1971 |
| GB | 1428018 | | 3/1976 |
| GB | 2100573 | A | 1/1983 |
| GB | 2149287 | A | 6/1985 |
| GB | 2177890 | A | 2/1987 |
| NZ | 19697 | | 11/1983 |
| WO | WO 90/09741 | A | 9/1990 |
| WO | WO 99/26495 | A | 6/1999 |
| WO | WO 0000047 | | 1/2000 |
| WO | WO 01/13745 | A1 | 3/2001 |
| WO | WO 02/03819 | A | 1/2002 |
| WO | WO 2006/070289 | A | 7/2006 |
| WO | WO 2006/082529 | A | 8/2006 |
| WO | WO 2007/093757 | A1 | 8/2007 |
| WO | WO 2007/110650 | A1 | 10/2007 |

OTHER PUBLICATIONS

U.S. Appl. No. 11/826,016, Smoking Article With Impaction Filter Segment.
International Preliminary Report on Patentability issued Feb. 3, 2009 for PCT/IB2007/003165.
Written Opinion dated Aug. 5, 2004 for International Application No. PCT/US04/04530.
International Search Report dated Aug. 5, 2004 for PCT/US04/04530.
International Search Report dated Oct. 19, 2007 for International Application No. PCT/IB2006/004202.
Written Opinion dated Oct. 19, 2007 for International Application No. PCT/IB2006/004202.
Invitation to Pay Additional Fees and Annex to Form PCT/ISA/206 Communication Relating to the Results of the Partial International Search dated Oct. 16, 2007 for International Application No. PCT/IB2006/004209.
International Search Report and Written Opinion dated Mar. 17, 2008 for PCT/IB2006/004209.
International Preliminary Report on Patentability dated Jul. 10, 2008 for PCT/IB2006/004202.
International Preliminary Report on Patentability dated Jul. 10, 2008 for PCT/IB2006/004209.
International Search Report and Written Opinion dated Sep. 19, 2008 for PCT/IB2007/004503.
International Preliminary Report on Patentability mailed Jul. 9, 2009 for PCT/IB2007/004503.
International Preliminary Report on Patentability mailed Sep. 24, 2009 for International Application No. PCT/IB2008/001372.
International Preliminary Report on Patentability for PCT/IB2007/004224 dated May 19, 2009.
International Preliminary Report on Patentability for PCT/GB2007/001144 dated Sep. 30, 2008.
International Search Report and Written Opinion for PCT/IB2007/004224 dated Jun. 13, 2008.
International Preliminary Report on Patentability mailed Sep. 15, 2009 for PCT/IB2008/001383.
International Search Report and Written Opinion mailed Feb. 24, 2009 for PCT/IB2008/001383.
Partial International Search Report mailed Nov. 11, 2008 for PCT/IB2008/001383.
International Preliminary Report on Patentability issued Jan. 13, 2009 for PCT/IB2007/002869.
International Search Report and Written Opinion dated Jan. 25, 2008 for PCT/IB2007/002869.
International Preliminary Report on Patentability issued Jan. 13, 2009 for PCT/IB2007/002910.
International Search Report and Written Opinion dated Jan. 24, 2008 for PCT/IB2007/002910.
International Search Report and Written Opinion mailed Jan. 27, 2009 for PCT/IB2008/001348.
International Preliminary Report on Patentability issued Sep. 15, 2009 for PCT/IB2008/001348.
New Zealand Examination Resort cited in New Zealand Patent Application No. 573730, Jul. 8, 2010.
International Search Report and Written Opinion dated Oct. 7, 2008 for PCT/IB2008/001382.
International Preliminary Report on Patentability issued Sep. 15, 2009 for PCT/IB2008/001382.
New Zealand Examination Report cited in New Zealand Patent Application No. 571453, Mar. 10, 2010.
International Search Report and Written Opinion dated Mar. 26, 2008 for PCT/IB2007/003165.
U.S. Appl. No. 12/576,922, filed Oct. 9, 2009.
U.S. Appl. No. 12/782,443, filed May 18, 2010.
International Search Report mailed Sep. 13, 2010 for International Application No, PCT/EP2010/003016.

* cited by examiner

SMOKING ARTICLE WITH SINGLE PIECE RESTRICTOR AND CHAMBER

CROSS REFERENCE TO RELATED APPLICATION

This application claims priority under 35 U.S.C. §119(e) to U.S. provisional Application No. 60/836,144, filed on Aug. 8, 2006, the entire content of which is incorporated herein by reference.

BACKGROUND

The present invention relates to ventilated cigarettes, ventilated cigarette filters and methods of making same.

SUMMARY

A smoking article having a filter segment that establishes both a desired resistance to draw and a mixing of mainstream smoke with ventilation air.

DETAILED DESCRIPTION

Figure 1:
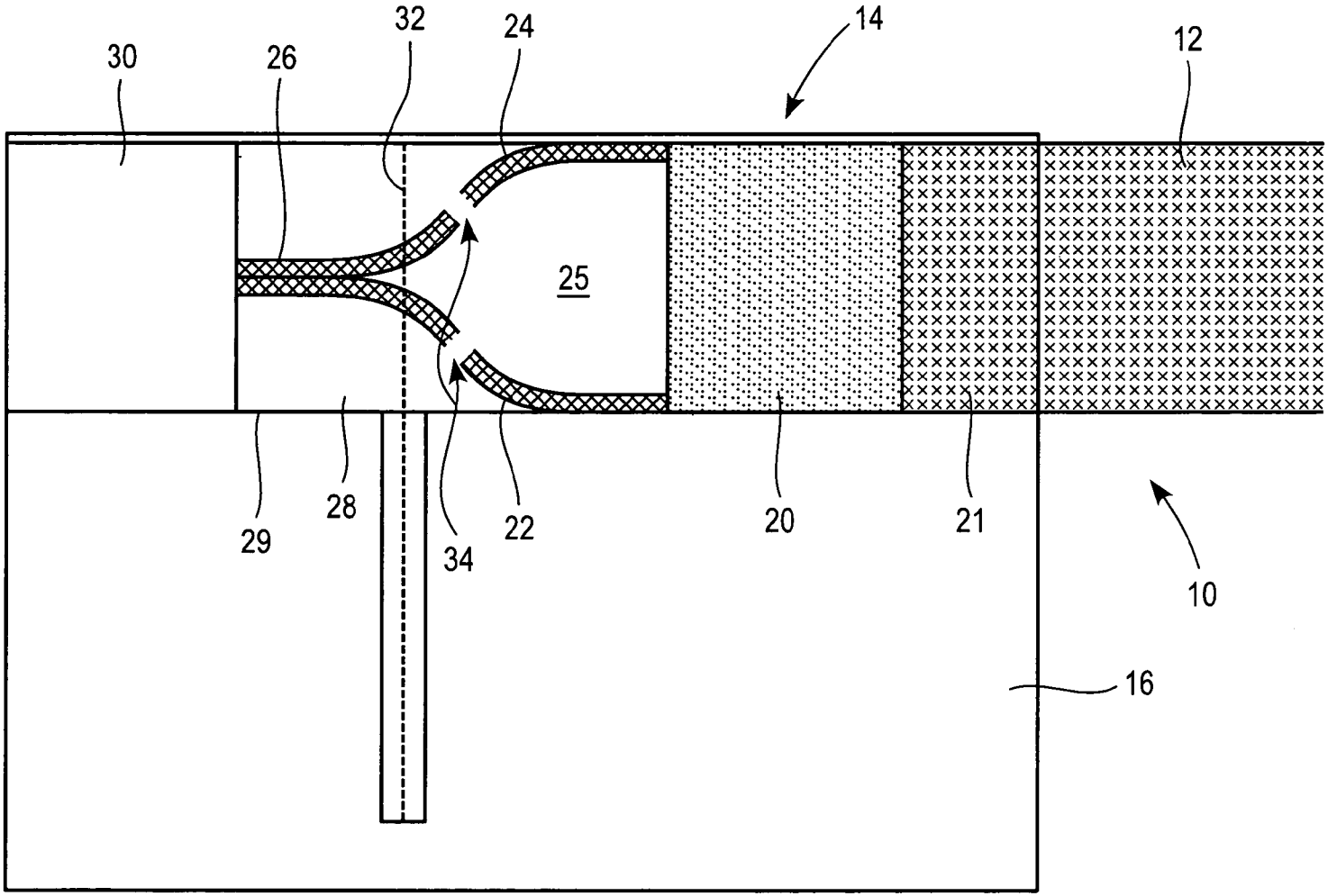
FIG. 1 is a cross-sectional side cut-away view of a preferred embodiment, with the tipping paper having been partially unraveled.

A preferred embodiment provides a smoking article 10 comprising a tobacco rod 12 and a filter 14 which are joined together by a tipping paper 16.

The filter 14 comprises a first filter segment 20 adjacent the tipped end 21 of the tobacco rod 12. Preferably, the first filter segment 20 is constructed of a fibrous cellulose acetate (CA) tow or a plug of cellulose acetate tow laden with activated carbon particles (COT), beads or other absorbents.

The filter 14 further comprises a second filter segment 22 in downstream relation to the first segment 20 (in the sense of direction that mainstream smoke is drawn through the filter 14 during a puff). The second filter segment 22 includes a hollow frusto-conical upstream portion 24 and a fluted downstream portion 26. The fluted downstream section can include one or more planar or non-planar walls defining voids 28. The diameter of the second filter segment 22 is approximately equal to that of the filter 14, such that the outer peripheries of portions 24, 26 and any (optional) plug wrap 29 are adjacent (abut) the tipping paper 16. The second filter segment 22 further includes one or more, preferably at least 2 orifices 34 at locations about the frusto-conical portion 24 that communicate the interior space 25 of the upstream frusto-conical portion 24 with one or more of the flutes (or "voids") 28 defined between the downstream fluted portion 26 and adjacent portions of a plug wrap 29 and/or the tipping paper 16.

Preferably, the filter 14 further comprises a mouthpiece filter segment 30 at the buccal end of the filter 14 and one or more rows of ventilation holes 32. The ventilation holes 34 are at a location along the filter 14 downstream of the orifices 34 and preferably are in superposed relation to the flutes ("voids") 28 of the downstream segment portion 26.

During a puff on the cigarette 10, mainstream smoke is drawn from the tobacco rod 12 into the filter 14 through the first segment 20 and then into the space 25 and through the orifices 34 of the upstream portion 24 of the second filter segment 22. Upon entering the flutes 28 of the downstream segment portion 26, the mainstream smoke is mixed with ventilation air that is drawn through the ventilation holes 32. The ventilated mainstream smoke is then drawn through the mouthpiece filter and out the cigarette 10.

Figure 3:
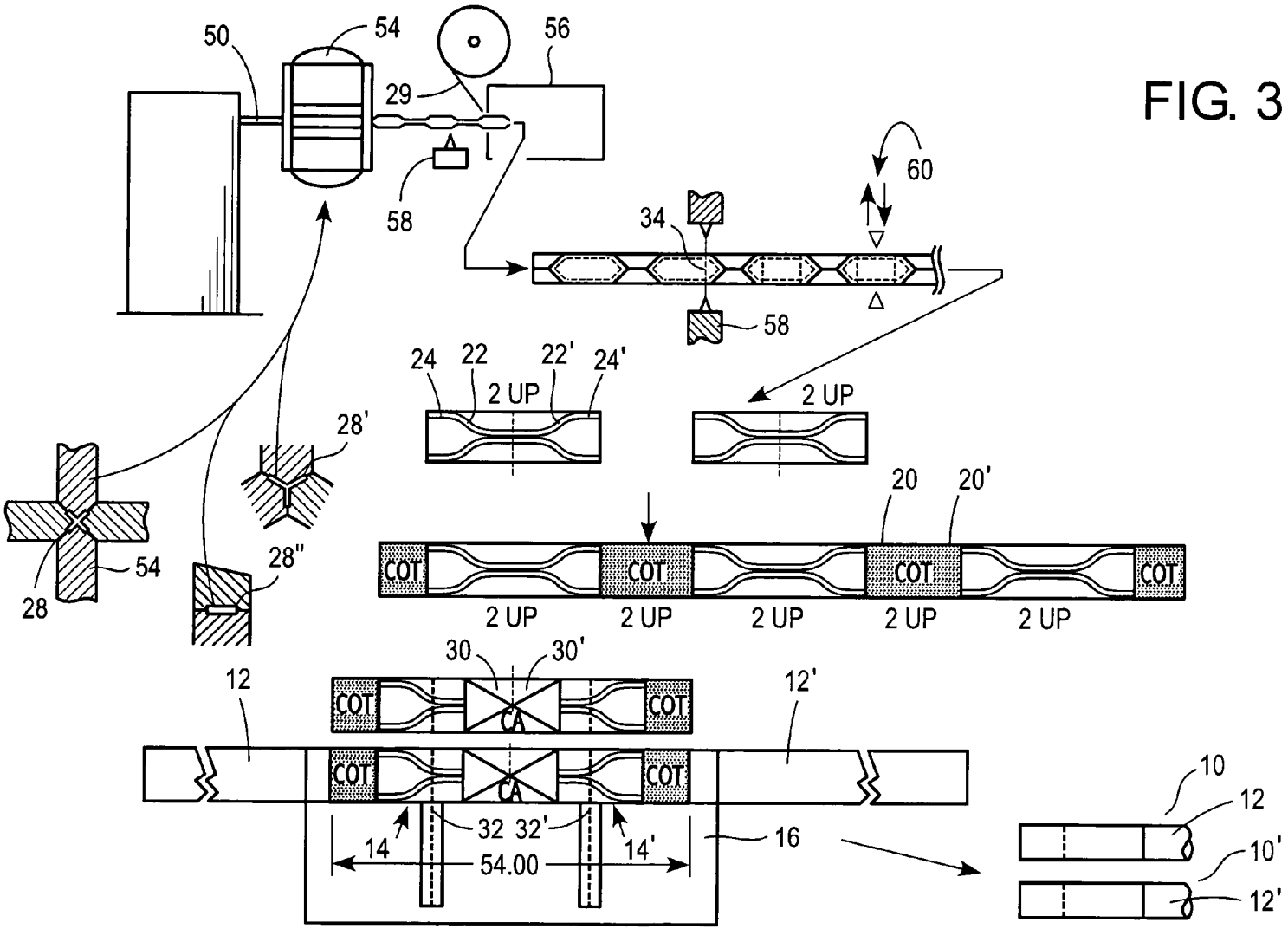
FIG. 3 is a representation of a method of manufacturing the cigarette and filter of the preferred embodiment.

In the preferred embodiment, the downstream filter segment is formed to establish four (4) flutes 28, whereas three (3), two (2) or one (1) flutes might be arranged instead (28', 28" in FIG. 3). More than four flutes are also a possibility.

A preferred material for construction of the second filter segment 22 is a heavy wrapping paper such as non-permeable 0.006 inch thick paper similar to that used in a Parliament recessed filter cigarette or stiff porous plug wrap. However, other materials may be used such as polyethylene, polypropylene and the like, non-woven stable fibers, and/or extruded open-celled foamed material, e.g., cellulose acetate filamentary tow material. For example, the second filter segment can be made from high density polyethylene and/or polypropylene.

The first filter segment 20 prevents tobacco particles and the like from clogging the orifices 34 of the second filter segment 22. Preferably, it is constructed of cellulose acetate tow of low particulate efficiency, e.g., cellulose acetate tow of 8.0 denier per filament and 35000 total denier.

The mouthpiece filter segment 30 is preferably constructed from cellulose acetate tow and is of low particulate efficiency, e.g., cellulose acetate tow of 8.0 denier per filament and 35000 total denier.

The ventilation holes 32 are preferably laser perforations made by known online laser perforation techniques. However, pre-perforated tipping paper can also be used.

Figure 2:
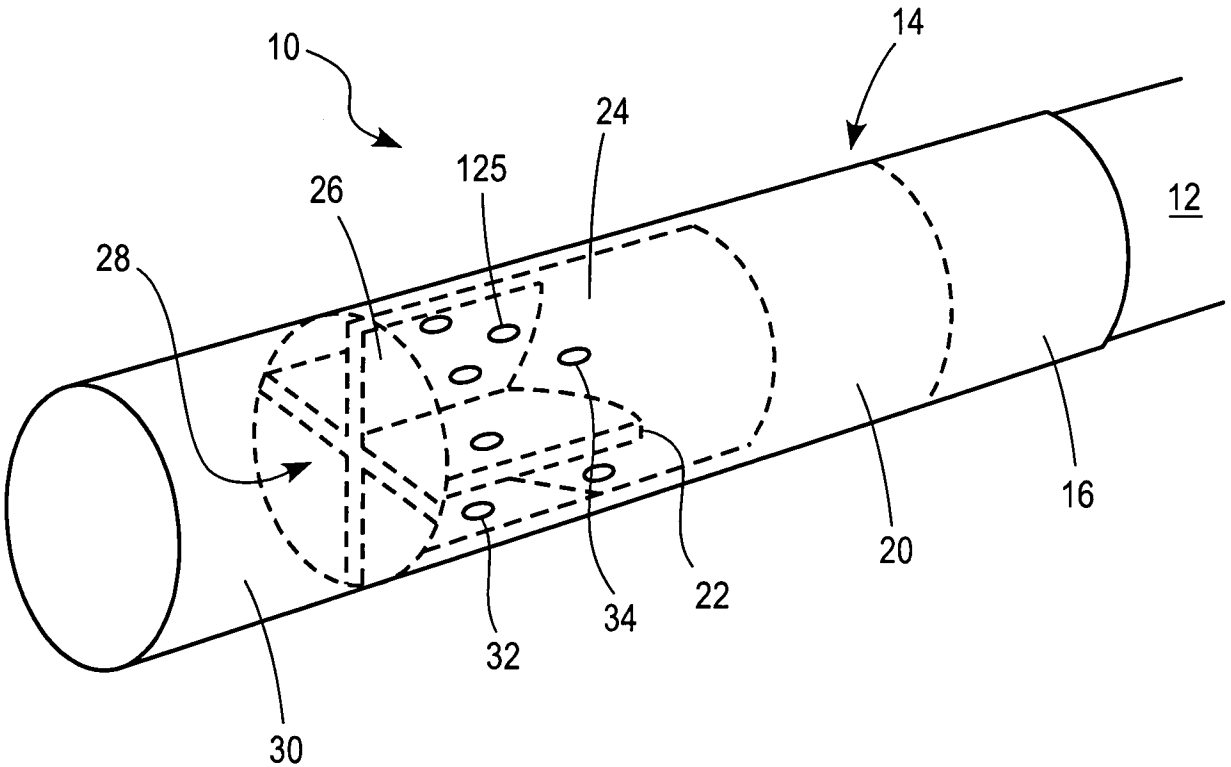
FIG. 2 is a perspective view of a preferred embodiment, with some internal features of the filter shown with dashed-lines.

The orifices 34 may be located and aligned relative to the flutes 28 such that they promote mixing of mainstream smoke with ventilation air along the flutes 28. Referring now to FIG. 2, in addition or in the alternative, the orifices 34 may be arranged to direct mainstream smoke toward adjacent surface regions 125 of the downstream fluted portion such that impaction of mainstream smoke is promoted to thereby remove a larger contingent of particles of tar from the mainstream smoke and to increase smoke particle filtration efficiency under higher flow rate or larger puff volume.

The cigarette 10 and the layout of its filter 14 are conducive to high speed manufacturing techniques including those taught in U.S. Pat. No. 4,357,950, hereby incorporated by reference in its entirety.

Referring now to FIG. 3, a method of manufacturing the cigarette 10 includes production of a continuous hollow tube 50 which is fed through a set of crimping wheels 54 whose perimeters form at their nip the aforementioned downstream fluted portions 26 of the second filter segments 22. Optionally, a plug wrap 29 can be added using a garniture 56 or other expedient. A laser 58 is employed to establish the orifices 34 at location(s) about the frusto-conical portion 24 of the second filter segment 22. A knife 60 severs the continuous, crimped rod into 2-up plugs of second filter segments 22, 22', which are combined with 2-up plugs of first filter segments 20, 20', which are severed in the middle of the 2-up second filter segments 22, 22' and combined with 2-up plugs of mouthpiece filter segments 30, 30' to form 2-up filters 14, 14'. Pairs of tobacco rods 12, 12' are tipped with 2-up filters 14, 14' and tipping paper 16 to form 2-up cigarettes, which are severed and laser perforated to establish ventilation holes 32.

The order of the aforementioned steps of manufacture may vary.

Preferably, the size of the orifices 34 can range from 0.4 to 0.8 mm in diameter and are sized to produce a desired range of resistance to draw, e.g., at least 50 mm water or greater, preferably 60 to 90 mm water, measured at a flow rate of 1050 cc/min; whereas the ventilation holes 32 are of such size and number so as to produce ventilation in the range of approximately 45 to 90%, more preferably in the range of approximately 50 to 80%.

With such filter and cigarette construction, there is achieved a mass-producible filter and smoking article of elevated ventilation with acceptable levels of RTD and with desirable organoleptic qualities of its smoke.

In another embodiment, when the second filter segment is constructed of polyethylene, polypropylene, and the like, the second filter segment can be fabricated using injection molding in either individual pieces or in multiples of 2, 4 or 6 (2-up, 4-up or 6-up) instead of the continuous process using a crimping wheel. The 2-up, 4-up or 6-up second filter segments fabricated by injection molding can be wrapped in a plug wrap of desired thickness and mechanical strength when combined with the upstream and/or downstream plugs of filter material such that the outer peripheries of the frusto-conical portion and the fluted portion and any optional plug wrap are adjacent the tipping paper.

The preferred embodiments are merely illustrative and should not be considered restrictive in any way. The scope of the invention is given by the appended claims, rather than the preceding description, and all variations and equivalents which fall within the range of the claims are intended to be embraced therein.

We claim:

1. A smoking article comprising a tobacco rod extending in an axial direction, a filter and a tipping paper operatively connecting said filter with said tobacco rod, said filter comprising a single piece restrictor filter segment having a fluted section, a frusto-conical section having an open upstream end and a closed downstream end, orifices that establish both a desired resistance to draw and a mixing of mainstream smoke with ventilation air, and a downstream plug of filter material, wherein outer peripheries of the fluted section and the frusto-conical section are adjacent the tipping paper and wherein the fluted section includes at least two walls defining voids between the walls and each of the orifices is in fluid communication with one of the voids, the walls of the fluted section terminating in a plane perpendicular to the axial direction and in contact with the downstream plug of filter material, wherein ventilation holes are located along said filter downstream of said orifices and in fluid communication with one or more of said voids.

2. The smoking article of claim 1, further including a plug of filter material upstream of the filter segment.

3. The smoking article of claim 2, wherein said upstream plug of filter material comprises carbon on tow.

4. A smoking article comprising a tobacco rod extending in an axial direction, a filter and a tipping paper operatively connecting said filter with said tobacco rod, said filter comprising upstream and downstream plugs of filter material and a hollow member therebetween, the hollow member in the form of a single piece restrictor element having an upstream frusto-conical section having an open upstream end and a closed downstream end and a downstream fluted section including at least two walls defining voids between the walls, the outer peripheries of the fluted section and the frusto-conical section adjacent said tipping paper and the frusto-conical section including orifices therethrough communicating with the voids between the walls of the fluted section, the walls of the fluted section terminating in a plane perpendicular to the axial direction and in contact with the downstream plug of filter material, wherein ventilation holes are located along said filter downstream of said orifices and in fluid communication with said voids.

5. The smoking article of claim 4, wherein the fluted section includes four planar walls defining four voids and the frusto-conical section includes four orifices, each of the orifices in fluid communication with a respective one of the voids.

6. The smoking article of claim 4, wherein the outer diameter of the frusto-conical section of the hollow member is approximately equal to the diameter of the upstream plug of filter material.

7. The smoking article of claim 4, wherein the frusto-conical section of the hollow member abuts the upstream plug of filter material.

8. The smoking article of claim 4, wherein the hollow member includes a sorbent.

9. A method of making a filter extending in an axial direction comprising the steps of:

repetitively forming single piece restrictor filter segments having a fluted portion including two walls defining voids between the walls and a frusto-conical portion having an open upstream end and a closed downstream end;

repetitively forming axially extending orifices in said filter segments to establish communication between said fluted portion and said frusto-conical portion;

repetitively combining said filter segments with mouthpiece filter segments and upstream filter segments; and establishing ventilation at a location along said fluted portion, wherein the orifices are in fluid communication with the voids, the walls of each fluted portion terminating in a plane perpendicular to the axial direction and in contact with one of the mouthpiece filter segments.

* * * * *